US008515105B2

(12) United States Patent
Yadegari

(10) Patent No.: US 8,515,105 B2
(45) Date of Patent: Aug. 20, 2013

(54) SYSTEM AND METHOD FOR SOUND GENERATION

(75) Inventor: Shahrokh Yadegari, San Diego, CA (US)

(73) Assignee: The Regents of the University of California, Oakland, CA (US)

( * ) Notice: Subject to any disclaimer, the term of this patent is extended or adjusted under 35 U.S.C. 154(b) by 1428 days.

(21) Appl. No.: 11/846,328

(22) Filed: Aug. 28, 2007

(65) Prior Publication Data

US 2008/0056522 A1 Mar. 6, 2008

Related U.S. Application Data

(60) Provisional application No. 60/840,865, filed on Aug. 29, 2006.

(51) Int. Cl.
*H04R 5/02* (2006.01)
*H04R 5/00* (2006.01)

(52) U.S. Cl.
CPC ..... *H04R 5/02* (2013.01)
USPC ..... 381/310; 381/17; 381/18

(58) Field of Classification Search
USPC ..... 381/17, 18, 310
See application file for complete search history.

(56) References Cited

U.S. PATENT DOCUMENTS 5,027,687 A * 7/1991 Iwamatsu ..... 84/600
5,784,467 A * 7/1998 Asayama ..... 381/17
6,111,962 A * 8/2000 Akio ..... 381/63
6,154,549 A * 11/2000 Arnold et al. ..... 381/104
6,430,535 B1 * 8/2002 Spille et al. ..... 704/500
7,099,482 B1 * 8/2006 Jot et al. ..... 381/61
2004/0234076 A1 * 11/2004 Agostini ..... 381/18

OTHER PUBLICATIONS

Kaup, A., LMS Introduction, Friedrich-Alexander University Erlangen-Nuremberg, <http://www.Int.de/LMS/research/projects/WFS/index> retrieved on Oct. 2, 2009, 3 pages.
TKK Akustiikka, "Vector base amplitude panning", obtained Dec. 5, 2008 <<http://www.acoustics.hut.fi/research/cat/vbap/>>, 2 pages.
Yadegari, S., "Inner Room Extension of a General Model for Spatial Processing of Sounds," Proceedings of International Computer Music Conference, pp. 244-247, Sep. 2005.
Yadegari, S., et al., "Real-Time Implementation of a General Model for Spatial Processing of Sounds", Center for Research in Computing and the Arts, San Diego, CA, 2002, 4 pages.

(Continued)

*Primary Examiner* — Duc Nguyen
*Assistant Examiner* — Anita Masson
(74) *Attorney, Agent, or Firm* — Perkins Coie LLP

(57) ABSTRACT

A system and method for generating a sound that simulates a fictitious sound perceived to emanate from a fictitious sound location is disclosed. In at least one aspect, the system includes a first surface serving to at least partially enclose a first region, a first speaker positioned on the first surface, a second region within the first region, and a sound reflecting boundary to enclose the first region. The system further includes a first fictitious source location within the first region, the location being outside of the second region, and a control device coupled at least indirectly within the first speaker. The control device generates control signals configured to cause the first speaker to generate sounds that in turn produce actual sounds that simulate fictitious sounds perceived to emanate from fictitious sound locations.

18 Claims, 3 Drawing Sheets

(56) References Cited

OTHER PUBLICATIONS

Yadegari. S. "Chaotic Signal Synthesis with Real-Time Control: Solving Differential Equations in PD, Max/MSP, and JMax," Proceedings of the 6th International Conference on Digital Audio Effects, London, UK, Sep. 2003, 4 pages.

Moore, F.R., "The Computer Audio Research Laboratory at UCSD," Computer Music Journal, 6(1):18-29, 1982.

Moore, F.R., "A General Model for Spatial Processing of Sounds", Computer Music Journal, 7(3):6-15, 1983.

* cited by examiner

SYSTEM AND METHOD FOR SOUND GENERATION

CROSS-REFERENCE TO RELATED APPLICATIONS

This application claims the benefit of U.S. provisional patent application no. 60/840,865 entitled "System and Method for Sound Generation" filed on Aug. 29, 2006, which is hereby incorporated by reference herein.

STATEMENT REGARDING FEDERALLY SPONSORED RESEARCH OR DEVELOPMENT

- -

Field of the Invention

The present invention relates to sound generation systems such as, for example, speaker systems, and more particularly relates to sound generation systems that operate to generate sounds that simulate sounds that would be provided by things (animate or inanimate) positioned at locations other than those at which the sound generating equipment is positioned.

BACKGROUND OF THE INVENTION

There continues to be a need for enhanced stereo and other sound generating systems for use in a variety of environments including, for example, movie theaters, homes and automobiles. In particular, audience members continue to desire an ever-more intense and realistic entertainment experience. Among the new technologies that have been developed in this regard are sound generating technologies that allow an audience member to hear sounds that appear to be coming from locations outside of the physical environment in which the audience member is situated, e.g., outside a theater. For example, in a movie environment in which an airplane is being displayed on the movie screen, apparently at a location far beyond the physical location of the screen itself, such new technologies can allow an audience member to hear sounds that appear to the audience member as if they had originated from the fictitious, distant airplane rather than from the audio speakers positioned around the theater.

One such technology that has allowed for such simulated sounds to be achieved was developed by F. Richard Moore, and is described in "*A general model for spatial processing of sounds*", Computer Music Journal, 7(6):6-15, 1983, which is hereby incorporated by reference herein. To achieve such simulated sounds, this technology models a given physical environment of an audience member as having two nested areas. The outer room is an imaginary acoustic space within which the inner room (or the real performance space, e.g., the theater room) is located. The inner room is denoted by the location of the speakers which simulate the sound heard in the inner room as if the speakers were "openings" connecting the inner and the outer room. The spatial impression is produced by diffusing simulated direct sound rays, early echos, and global reverberation of the sound sources as heard at each speaker location. Based on the location of the source and geometry of the inner and outer rooms, simple ray-tracing algorithms are used to calculate the direct and reflected rays to the speaker locations. Direct paths are simply straight lines to the speaker locations.

FIG. 1 illustrates this Prior Art manner of modeling fictitious sounds coming from a fictitious source positioned outside a region, which allows for the generation of actual sounds by one or more sound sources (e.g., speakers) positioned along the border of the region such that at one or more locations within the region the actual sounds appear as if they were emanating from the fictitious source. More particularly, FIG. 1 shows exemplary paths 8, 10 for first order reflections of sound waves (represented by rays) emanating from a fictitious source 2 located outside of an inner region 4 having a boundary 6, within which could be located audience member(s) (or other listener(s) or listening device(s)), e.g., a room such as a theater chamber, etc.

As shown, the paths 8, 10 are shown to travel from the fictitious source 2 toward an outer boundary 16 of a second, outer region 14 encompassing the inner region 4, at which the paths then are reflected toward the inner region 4. The particular paths shown are those which travel from the fictitious source 2 toward each of four exemplary speaker locations 12 located at corners of the region 4, albeit it will be understood that other paths will also occur and could be shown. The exemplary paths 8, shown as solid lines, are paths that need not traverse the boundary 6 of the inner region 4 in order to arrive at their respective speaker locations 12, while the exemplary paths 10, shown as dashed lines, are paths that need to traverse the boundary 6 and a portion of the inner region 4 in order to arrive at their respective speaker locations.

Other than continuous control over the location of the fictitious source 2, three other parameters are defined to characterize the diffusion pattern of the sound source. Thus, a radiation vector (RV) is defined as follows:

$$RV=(x,y,\theta,\text{amp},\text{back}), \tag{1}$$

where x and y denote the location of the source with (0,0) being at the center of the inner room, θ is the source radiation direction, amp is the amplitude of the vector, and back is the relative radiation factor in the opposite direction of θ (0<back<1). Back and θ are used to denote the supercardiod shape for radiation pattern of the sound source. Setting back to zero denotes a strongly directional source and setting back to one denotes an omnidirectional source.

The following equation (2) is used to calculate the amplitude scale factor for a simulated sound ray:

$$r(\varnothing) = \left[1 + \frac{(\text{back} - 1)|\theta - \varnothing|}{\Pi}\right]^2 \tag{2}$$

where r(ø) is the scale factor and ø is the direction of the ray being simulated. Subsequently, the final attenuation factor for each simulated sound ray is calculated based on the following equations:

$$\alpha_i=\rho_i K_i B_i D_i \tag{3}$$

$$D_i = \frac{1}{d_i^y} \tag{4}$$

where α is the total attenuation factor, ρ is the amplitude scalar determined based on the radiation pattern of the sound source and the angle by which the sound ray leaves the source (see eqn. 2), K is the "cut factor" (zero if a sound ray "cut"s through a wall of the inner room, and one otherwise), B accounts for absorption at reflection points, D is the attenuation factor due to the length of the path calculated based on d, the distance that the ray has to travel, and y denotes the power law governing the relation between subjective loudness and distance.

The delay values for each simulated sound ray is calculated by the relation $$\tau_i = \frac{R \times d_i}{c} \quad (5)$$

where τ is the delay value, R is the sampling rate in Hz, $d_i$ is the distance between the source and a speaker, and c is the speed of sound. Moore made a partial, though fairly complete, practical and useful, implementation of the general model in the "space unit generator" of cmusic. This implementation used a fixed 50 millisecond fade time for turning sound rays on and off based on the result of the "cut" factor of each ray and the inner walls.

The above-described scheme of Moore works well so long as a given fictitious source such as the source 2 can be assumed to be located outside of the boundary 6 on which the speakers are located, at a considerable distance from that boundary 6. The scheme simulates spatial impressions by assuming that the sounds of an outer room are heard inside an inner room, such that the model's results are more convincing when the source is outside the inner room. In most applications it is not desired for the inner room to have a physical presence; meaning that when a sound source passes through a wall, it is usually not meant to be heard as such.

However, the above-described scheme does not address the need for allowing simulated sounds of things (both animate and inanimate) located within the boundary 6 along which speakers are located (e.g., within the inner region 4). When the source is inside the inner region, the model can no longer be applied realistically, hence the undesirable effect of speakers in opposite sides turning on and off abruptly when a sound source passes through an inner wall. For example, if a source comes close to a wall of the inner region or if it passes through the boundary of that region, turning on and turning off speakers with a fixed 50 millisecond delay in opposite speakers to the wall would be perceived as noticeable distraction.

For at least these reasons, therefore, it would be advantageous if an improved method and system could be developed that allowed for sounds to be generated within a region such as (but not limited to) a theater, where the generated sounds gave the appearance to audience member(s) (or other listener(s) or listening device(s)) within the region that the sounds were emanating from one or more thing(s) located within the region instead of outside of the region (or in addition to).

SUMMARY OF THE INVENTION

In at least some embodiments, the present invention relates to a method of generating an actual sound that simulates a fictitious sound supposedly emanating from a first location within a first region, where the actual sound is to be sensed at a second location within the first region. The method includes determining the fictitious sound, and identifying a second region within the first region, where the first location is positioned outside the second region while still being positioned inside the first region. The method additionally includes calculating at least one adjustment value based at least in part upon the position of the second region, and generating a modified sound at a first speaker positioned proximate a first boundary of the first region, the modified sound being determined from the fictitious sound at least in part based upon the at least one adjustment value. The generating of the modified sound at the first speaker results in the generating of the actual sound at the second location.

Further, in at least some embodiments, the present invention relates to a method of generating actual sounds that simulate fictitious sounds supposedly emanating from a fictitious source at a first location and moving within a first region, where the actual sounds are to be sensed at a recipient location within the first region. The method includes determining the fictitious sounds, and identifying a second region within the first region, where the recipient location is within the second region and where the first location is positioned outside the second region while still being positioned inside the first region. The method additionally includes determining whether fictitious ray paths connecting the fictitious source with a fictitious speaker as the source moves must cross a second boundary of the second region in order to reach the fictitious speaker, where the fictitious speaker is positioned proximate the second boundary, and where the fictitious ray paths proceed from the fictitious source to a third boundary of a third region extending around the first region, are reflected off of the third boundary and subsequently proceed to the fictitious speaker. The method further includes generating modified sounds at a first speaker positioned proximate a first boundary of the first region, the modified sounds being determined at least in part based upon the determining of whether the fictitious ray paths must cross the second boundary, where the generating of the modified sounds at the first speaker results in the generating of the actual sounds at the recipient location.

Additionally, in at least some embodiments, the present invention relates to a system including a first surface serving to at least partially enclose a first region, a first speaker positioned on the first surface, and a second region within the first region. The system further includes a first fictitious source location within the first region, the location being outside of the second region, and a control device coupled at least indirectly within the first speaker. The control device generates control signals configured to cause the first speaker to generate first sounds that in turn produce actual sounds within the second region, and the actual sounds simulate fictitious sounds emanating from the first fictitious source location.

DETAILED DESCRIPTION OF THE PREFERRED EMBODIMENT

Figure 2:
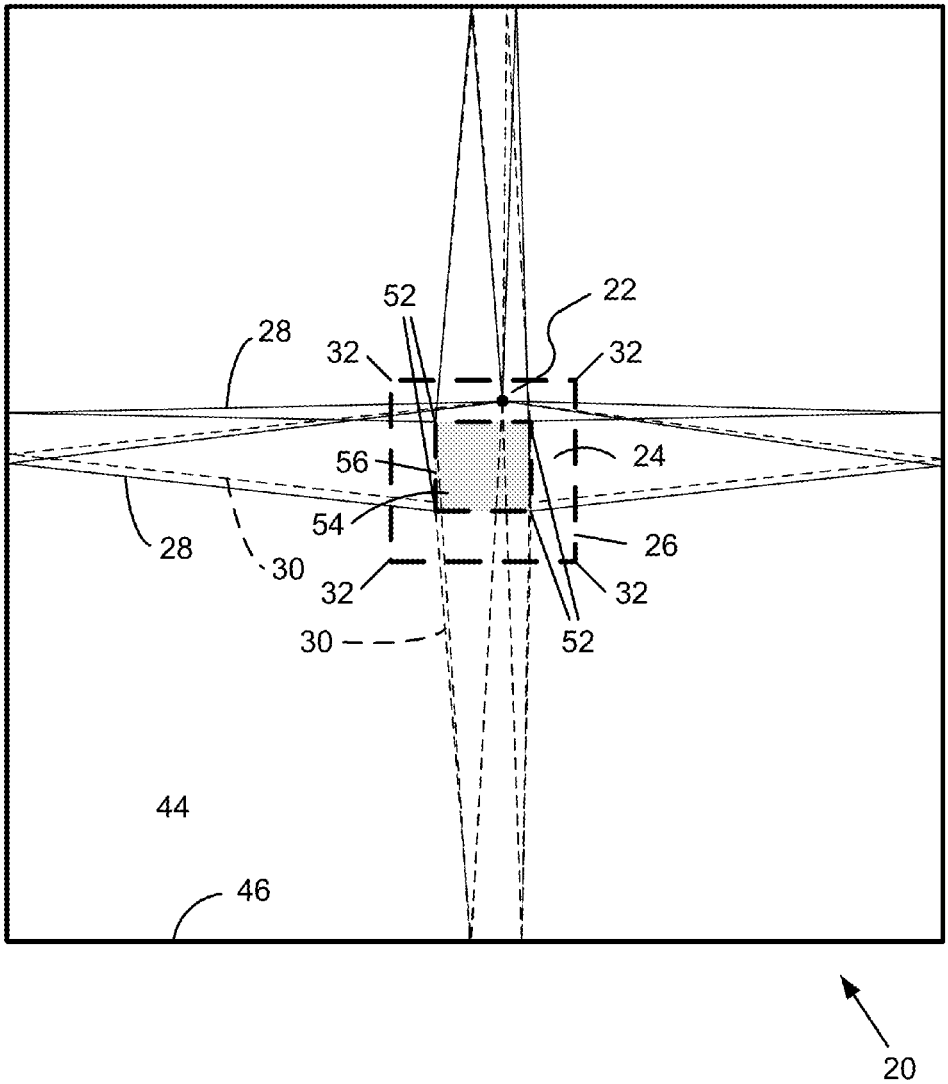
FIG. 2 illustrates an improved manner of modeling fictitious sounds coming from a fictitious source in accordance with at least some embodiments of the present invention, where this manner of modeling the sounds allows for the generation of actual sounds by sound source(s) positioned along the border of a region even when the fictitious source is located within that region.

Referring to FIG. 2, a schematic diagram 20 illustrates an improved manner of modeling fictitious sounds coming from a fictitious source 22 in accordance with at least some embodiments of the present invention. This manner of modeling the fictitious sounds allows for actual sounds to be generated within a first region 24 by one or more sound generating source(s) such as speakers located along a boundary 26 of that region, where the actual sounds give the appearance to one or more listener(s) (e.g., audience member(s) or other listener(s) or listening device(s)) of emanating from the fictitious source 22 even though the fictitious source is located within the first region 24 rather than outside that region as presumed in the Prior Art modeling methodology described above. Thus, while (as in the Prior Art embodiment described above) FIG. 2 shows exemplary paths 28 and 30 extending from the fictitious source 22 toward an outer boundary 46 of a second, outer region 44, which are then reflected back inward toward the first region 24, the fictitious source 22 is located within the first region 24 rather than outside that region (in contrast to the Prior Art embodiment).

In accordance with at least some embodiments of the present invention, the improved manner of modeling the fictitious sounds includes three aspects: 1) an improved ray inter-section algorithm, 2) definition of nested imaginary inner rooms; and 3) slightly altered delay time and attenuation factor calculations. These three aspects, as well as a system and method for generating actual sounds based upon the results of applying this model, are described in further detail below.

Improved Ray Intersection Algorithm

In accordance with at least some embodiments of the present invention, a simple frequency independent ray intersection algorithm for fading in/out sound rays in speakers smoothly as a sound source moves in the space can be employed. Instead of producing binary "cut" factors, in this algorithm fractional "cut" factors are calculated based on a distance between the edge of an inner wall and the intersection point, a diffraction threshold, and a crossfade factor. If a ray intersects with multiple walls, the final "cut" factor is calculated as the product of the "cut" factors with each wall, according to the following relations:

$$k_{i,s} = \begin{cases} 0 & \text{When } \delta_{i,s} > TH, \\ \left(\frac{TH - \delta_{i,s}}{TH}\right)^{CF} & \text{When } TH > \delta_{i,s} > 0 \end{cases} \tag{6}$$

$$K_i = \prod_{S=1}^{S} k_{i,s} \tag{7}$$

where $k_{i,s}$ is the diffraction attenuation factor for ray i intersecting with surface s, $\delta_{i,s}$ is the distance between intersection point and the corner of the wall, TH is the diffraction threshold variable (TH could be defined as a constant or as a fraction of the size of the wall), CF is the crossfade exponential factor, S is the number of surfaces of the inner room, and $K_i$ is the final "cut" factor for ray i.

Imaginary Inner Rooms

In accordance with at least some embodiments of the present invention, the first region 24, is understood to correspond to a physical region such as a room, along the boundary 26 of which is to be positioned one or more sound generating sources (e.g., speakers). Additionally the first region 24 is understood to encompass one or more nested imaginary regions (or rooms), one of which is shown in FIG. 2 as a third region 54 having an outer boundary 56. The specific imaginary region 54 chosen for calculations typically is the largest possible inner region based on the location of the fictitious source 22, such that the source is always outside of that inner region regardless of movement of the source as shown in FIG. 2. Where multiple nested imaginary regions are identified, the innermost imaginary inner region is a point at the center of the first region 24 and has dimensions of zero.

Figure 1:
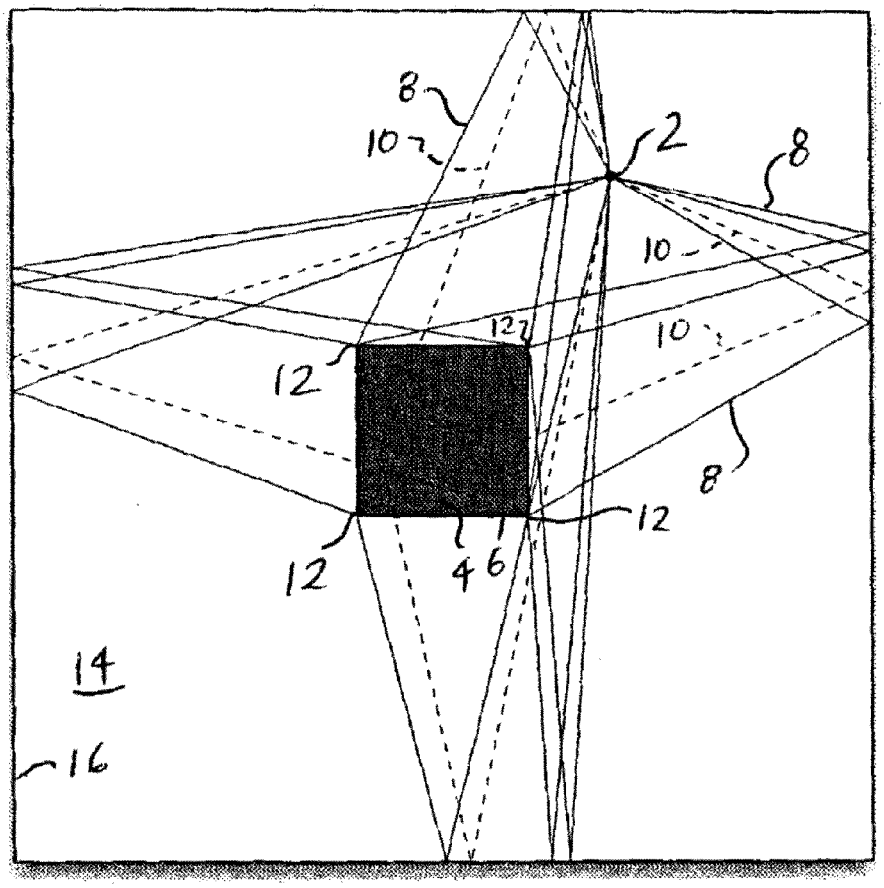
FIG. 1 PRIOR ART
FIG. 1 illustrates a Prior Art manner of modeling fictitious sounds coming from a fictitious source positioned outside a region that allows for the generation of actual sounds by one or more sound sources (e.g., speakers) positioned along the border of the region such that at one or more locations within the region the actual sounds appear as if they were emanating from the fictitious source.

As with the Prior Art model described with respect to FIG. 1, the present model presumes that one or more actual speakers (or other sound generating devices) are located at one or more speaker locations 32 along the boundary 26 of the first region 24, e.g., at the four corners of that region as shown in FIG. 2. At the same time, the present model further defines imaginary speakers to be located at one or more speaker locations 52 along the boundary 56 of that third region 54, e.g., at the four corners of that region. The imaginary speakers can be understood as being located at the intersections of the lines drawn from the center of the room to each real speaker location, and the walls of the imaginary room. Thus, the exemplary paths 28, 30 shown in FIG. 2 as extending from the fictitious source 22 extend from that source to the boundary 46 and, upon being reflected at that boundary, then proceed to the four speaker locations 52.

As described in Her detail below, attenuation factors and delay times for each path (ray) will be calculated in relation to the chosen imaginary room. Thus, the sound diffused by each speaker located at the boundary 26 of the first region 24 (which is typically the real, physical room within which a listener or listening device is located) is attenuated and delayed in proportion to the distance between the center of the room and the location of the imaginary speaker that the real speaker is shadowing.

Also, the diffraction threshold factor TH and the crossfade factor CF will also be set for each imaginary region/room such as the region 54. Various implementations can offer linear or exponential scaling of TH and CF for imaginary inner rooms (e.g., the closer one gets to the center of the room, the smaller the TH factor could get). Keeping TH constant for all the imaginary rooms will cause the walls of smaller imaginary rooms to be more translucent. Thus, when a source travels from outside of the main inner room towards the center of the room, the speakers located on the opposite wall gradually become louder as the source approaches the center of the room. In such a scenario, when the source gets closer to the center of the inner room, the closer the "cut" factors get to one.

Delay and Attenuation Factor Calculations

In the Prior Art model of Moore described above, delay values and their corresponding attenuation factors are calculated based on the distance between the fictitious source and speaker location. In contrast, in accordance with at least some embodiments of the present invention, delay values can be calculated based on the distance between the source and a specific speaker (which could be an imaginary one), plus the distance between that speaker and the center of the room. Accordingly the attenuation factor $D_i$ used in equation 3 above would also be calculated based on the distance between the source and the center of the room, as follows:

$$\tau_i = \frac{R \times (d_i + \lambda_j)}{C} \tag{8}$$

$$D_i = \frac{1}{(d_i + \lambda_j + \Lambda)^{\gamma}} \tag{9}$$

where τ is the delay value, R is the sampling rate in Hz, $d_i$ is the distance between the source and the speaker on the chosen inner room, j is the speaker number of chosen inner room, $\lambda_j$ is the distance between that speaker and center of the room, c is the speed of sound, Λ is a constant distant factor added to further control the attenuation factors due to distance, and $\gamma$ denotes the power law governing the relation between subjective loudness and distance.

Also, in the Prior Art model of Moore, the sound diffused by a speaker would be louder if a source were located right on that speaker than the resulting diffused sound when a source is in the middle of the room. It is so, due to the fact that the delay and attenuation factors were calculated based on the distance between the source and the speaker. This matter further complicates the simulated spatial impression of a sound source inside of the inner room. By comparison, the calculation of delay times and attenuation factors in relation to the center of the room in accordance with embodiments of the present invention not only solves the above problem but also seamlessly accounts for the delay time simulation of imaginary speakers at the perimeter of an imaginary room by the physical speakers located at the perimeter of the primary inner room. Due to the fact that in this improved model attenuation factors are calculated in relation to the distance between the source and the center of the room, when a source is at the center of the room, all speakers are engaged with the least amount of attenuation. Thus, the resulting impression could perceptually become much stronger compared to when the source is at a considerable distance from the center. Even though $\gamma$ in equation 9 could be used to control the relation between attenuation of sounds due to distance, the addition of $\Lambda$ as a constant has been found to be useful to balance the sound levels between the simulated impressions when the source is in the center of the room or when it is her away.

Practical Implementation

Assuming that the improved model described above is utilized, it is possible for actual sounds to be generated by one or more speakers arranged around the boundary 26 of the first region 24 that, when heard by one or more listener(s) (e.g., audience member(s)) or listening device(s) (e.g., microphone(s)), appear to be emanating from the fictitious source 22 (or possibly from multiple such fictitious sources). More specifically, for the effect to be achieved, the listener(s) or listening device(s) must be positioned not only within the first region 24 but also more specifically within the assumed imaginary region(s) such as the third region 54.

Figure 3:
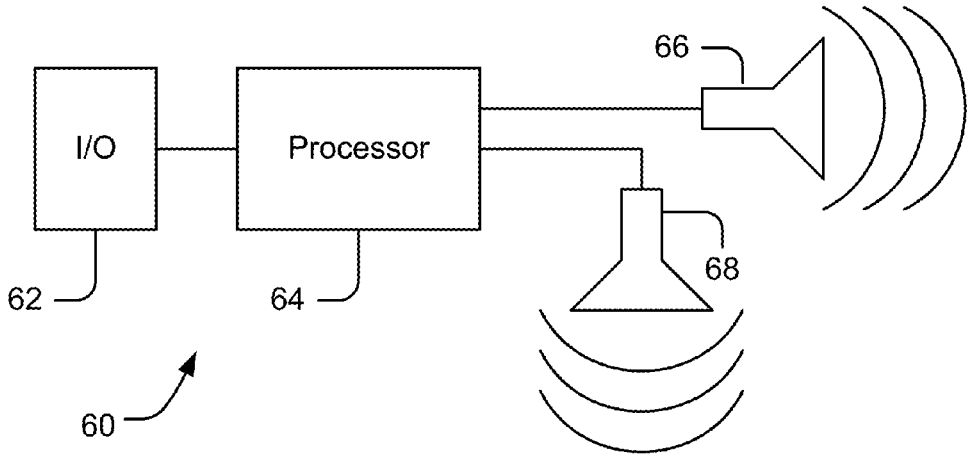
FIG. 3 shows in schematic form a system that can be used to generate the actual sounds in a region as represented by FIG. 2.

Referring to FIG. 3, a schematic diagram shows exemplary component parts of a system 60 that can produce such actual sounds through the use of the above-described model. As shown, the system 60 includes a computer or other processor 64 (e.g., a microprocessor) that is preferably capable of significant numbers of calculations in real time. The computer 64 receives information, for example, by way of one or more input/output devices 62 (which could be, for example, a keyboard, a network connection, etc.) that inform the computer 64 about the fictitious sounds that are supposed to be generated by one or more fictitious sources. This sound information could be, for example, portions of a sound track to a movie. The information received by the computer 64 also includes location information of the fictitious position(s) of the fictitious source(s), including possibly directional or velocity movement of the source(s) if they are supposed to be moving. The information received by the computer 64 also can include specific information of the one or more location(s) of one or more listener(s) or listening device(s) located within the actual physical region within which actual sounds are to be provided (e.g., within the first region 24).

Upon receiving this information, the computer 64 calculates signals that should be provided to one more speakers (in this example, shown to be first and second speakers 66 and 68) in order to generate actual sounds that, when heard by the listener(s) or listening device(s), will appear to emanate from the location(s) of the fictitious source(s). These calculations are achieved using the improved model described above. As described above, to use the improved model, one or more imaginary third regions such as the region 56 must be identified, within which are located the listeners) or listening device(s) but not the fictitious source(s). In at least some embodiments, the computer 64 itself is capable of determining the extent (and possibly number) of imaginary region(s) of interest automatically. Once the computer 64 determines the actual sounds that should be generated by the speakers 66, 68, the computer 64 sends appropriate signals to those speakers to generate those sounds. The components 62, 64, 66 and 68 shown in FIG. 3 can communicate with one another and with respect to outside components by way of any of a variety of communication formats and technologies including, for example, wired connections, wireless connections, internet connections, etc.

Additional Considerations

The spatial impression produced through the use of the improved model in accordance with embodiments of the present invention, for a source located inside of the first region 24, is optimal for a listener located at the center of the region. It should be understood that, when using loudspeakers, it is impossible to create the same spatial impression of a fictitious source located within the first region 24 for all listening locations within that room (e.g., within the third region 54). At the same time, this shortcoming need not be a significant drawback in many practical circumstances. For example, to the extent that this improved model is intended for performance situations, the above-mentioned shortcoming can be dealt with compositionally so that the different perceived spatial impressions will carry general meaningful musical connotations.

Also it should be noted that, if the physical speaker locations (e.g., the locations 32) are not located at an equal distance to the center of the first region 24, calculation of the delays in relation to the center of the room will cause exaggeration of any inequalities in the distance of the speakers to the center of the room. While this effect could be used musically, if the simulated impressions are to follow the original model, to use this extension, speakers should be placed in equal distance to the center of the room. At the same time, it should be noted that, while a recipient located at the center of the third region 54 will likely experience the best simulated impressions, recipients located at other locations other than the very center of the third region (e.g., recipients located at other locations within the third region) will also likely experience sounds that are enhanced relative to what they would be using Prior Art techniques.

Additionally, it should be noted that, while all of the regions 24, 44 and 54 shown in FIG. 2 are shown to be rectangular (square), two-dimensional regions, the present system and method employing the improved modeling methodology described above is not only applicable to such regions but also is applicable to two-dimensional regions of arbitrary shape (e.g., circular regions) as well as to three-dimensional regions of arbitrary shape (e.g., cubic regions, spherical regions, etc.). Thus, the present invention is intended to be applicable not only within rectangularly-shaped theater rooms, but also within a variety of other environments including, for example, home environments and automobiles. The present invention is also intended to be applicable for use in connection with virtual reality systems, including virtual reality systems providing imaging capabilities such as holographic imaging capabilities.

In at least some alternate embodiments, in order to achieve a more psychoacoustically salient spatialization (or localization) impression, direct or reflected simulated sound rays to the speakers along the boundary 26 of the first region 24 can be attenuated further based on the angle by which the direct ray or the last segment of a reflected ray arrives at a speaker. This attenuation factor can be between 0 (zero) and 1 (one). In particular, if a sound ray arrives at a speaker at an angle (angle "ray_angle") that is the same angle as the angle of the sound diffusion of the speaker (angle "speaker_angle"), the attenuation factor will be 1 (one), and if the ray arrives at the speaker exactly in the opposite direction of the angle of the sound diffusion of the speaker, the attenuation factor will be 0 (zero). Thus, a linear calculation of the attenuation factor ("angle_attenuation) based on the arrival angle of the ray to the speaker can be:

$$\text{angle_attenuation}=1-(|\text{ray_angle}-\text{speaker_angle}|/\Pi) \quad (10)$$

This technique can be particularly useful when the model is applied to three dimensions and when speakers are located on the corners of the box denoting the first region 24, where for simulating sound in most locations most speakers will be active.

It will further be understood that the present invention can also be used in combination with the Prior Art methodology described above. For example, if it is desired to generate actual sounds that appear to be emanating from a fictitious source that is moving from a location outside of the first region 24 of FIG. 2 to a location inside of that region, then the computer 64 can switch between the Prior Art methodology and the improved methodology in determining the actual sounds at a time when the fictitious source is supposedly crossing the boundary 26 of the region 24. Also, if the sounds of multiple fictitious sources both inside and outside the boundary 26 are to be simulated, the computer 64 can use both the Prior Art and improved techniques to simulate the sounds of the respective fictitious sources.

It is specifically intended that the present invention not be limited to the embodiments and illustrations contained herein, but include modified forms of those embodiments including portions of the embodiments and combinations of elements of different embodiments as come within the scope of the following claims.

I claim:

1. A method of sound simulation for generating an actual sound that simulates a fictitious sound that is perceived to be emanating from a perceived sound source at a first location within a first region, wherein the actual sound is to be sensed by a listener at a second location different from the perceived sound source at the first location, the method comprising:

providing for sound simulation a third region surrounded by a virtual external boundary that forms a space outside of and encloses (1) the first region surrounded by a first boundary to which at least a first speaker is proximately positioned to produce the actual sound and (2) a second region surrounded by a second boundary, the second region in a space located within the first region, wherein the perceived sound source at the first location is positioned outside the second region while still being positioned inside the first region, and the second location where the listener is located to experience the sound simulation is positioned inside the second region;

calculating at least one adjustment value based upon a position of the first location, a position of a fictitious speaker positioned proximate the second boundary of the second region, a position of the virtual external boundary, and a position of the center of the second region to include sound effects of sound traveling from the fictitious sound being generated by the perceived sound source to the virtual external boundary and bouncing back from the virtual external boundary to locations including the fictitious speaker, wherein the sound traveling includes sound paths that pass through the second region and sound paths that do not pass through the second region, and the included sound effects include an attenuation or a time delay based on a traveling distance of the fictitious sound with respect to the second boundary and the center of the second region; and generating a modified sound at the first speaker positioned proximate the first boundary of the first region, the modified sound being determined from the fictitious sound at least in part based upon using the at least one adjustment value, wherein the generating of the modified sound at the first speaker results in the perception of a sound being generated at the first location.

2. The method of claim 1, wherein the calculating at least one adjustment value is also based upon whether a path of a fictitious ray emanating from the first location passes through the second boundary, the path of the fictitious ray extending to the virtual external boundary, reflecting off of the virtual external boundary and extending therefrom to the fictitious speaker.

3. The method of claim 1, wherein the attenuation value is determined at least in part based on an angle by which a direct ray of the sound paths or a last segment of a reflected ray of the sound paths arrives at the first speaker.

4. The method of claim 2, wherein the at least one adjustment value includes a diffraction threshold factor and a cross-fade factor.

5. The method of claim 1, wherein an additional modified sound is generated at an additional speaker positioned proximate the first boundary of the first region, the first and the additional speaker being positioned at different locations, respectively.

6. The method of claim 1, wherein each of the first and second regions is rectangular in shape.

7. The method of claim 1, wherein each of the first and second regions is non-rectangular in shape.

8. The method of claim 1, wherein each of the first and second regions is a respective three-dimensional region.

9. A method of sound simulation for generating actual sounds that simulate fictitious sounds that are perceived to be emanating from a perceived sound source at a first location and moving within a first region, wherein the actual sounds are to be sensed by a listener at a recipient location, the method comprising:

providing for sound simulation a third region surrounded by a virtual external boundary that forms a space outside of and encloses (1) the first region surrounded by a first boundary to which at least a first speaker is proximately positioned to produce the actual sound and (2) a second region surrounded by a second boundary, the second region in a space located within the first region, wherein the listener at the recipient location is within the second region, and wherein the perceived sound source at the first location is positioned outside the second region while still being positioned inside the first region;

determining whether fictitious ray paths connecting the perceived sound source with a fictitious speaker positioned proximate the second boundary as the perceived sound source moves must cross the second boundary in order to reach the fictitious speaker, wherein the fictitious ray paths proceed from the perceived sound source to the virtual external boundary, are reflected off of the virtual external boundary and subsequently proceed to the fictitious speaker, and wherein the fictitious ray paths include paths that pass through the second region and paths that do not pass through the second region;

calculating at least one adjustment value based upon a position of the first location, a position of the fictitious speaker, a position of the virtual external boundary, and a position of the center of the second region, wherein the at least one adjustment value includes one or both of an attenuation and a time delay based on a traveling distance of the fictitious sounds with respect to the second boundary and the center of the second region; and generating modified sounds at the first speaker, the modified sounds being determined at least in part based upon the determining of whether the fictitious ray paths must cross the second boundary and the at least one adjustment value, wherein the generating of the modified sounds at the first speaker results in the perception of a sound being generated at the perceived sound source.

10. The method of claim 9, wherein the attenuation is determined at least in part based on an angle by which a direct ray of the paths or a last segment of a reflected ray of the paths arrives at the first speaker.

11. A system comprising:

a first surface serving to at least partially enclose a first region;

a first speaker positioned on the first surface;

a second region in a space within the first region;

a third region surrounded by a virtual external boundary that forms a space outside of and encloses the first region and the second region;

a first fictitious source location within the first region, the first fictitious source location being outside of the second region; and a control device coupled at least indirectly within the first speaker to generate control signals configured to cause the first speaker to generate actual sounds within the second region by calculating at least one adjustment value based at least in part upon a position of a fictitious speaker positioned proximate a second boundary surrounding the second region, a position of the first fictitious source location, a position of the virtual external boundary, and a position of the center of the second region, wherein the calculating by the control device determines sound effects of sound traveling from the fictitious sound being generated by the first fictitious source to the virtual external boundary and bouncing back from the virtual external boundary to locations including the fictitious speaker, wherein the sound traveling includes sound paths that pass through the second region and sound paths that do not pass through the second region, and the determined sound effects include one or both of an attenuation and a time delay based on a traveling distance of the sound with respect to the second boundary and the center of the second region, and wherein the control signals are determined at least in part based upon the at least one adjustment value, wherein the actual sounds simulate fictitious sounds emanating from the first fictitious source location.

12. The system of claim 11, wherein the system is for implementation within a theater and the first surface includes walls, a floor and a ceiling of the theater.

13. The system of claim 11, wherein the control device generates the control signals by:

determining whether fictitious ray paths connecting the first fictitious source location with a fictitious speaker as the first fictitious source location moves must cross a boundary of the second region in order to reach the fictitious speaker, wherein the fictitious speaker is positioned proximate the boundary of the second region, and wherein the fictitious ray paths proceed from the first fictitious source location to the sound reflecting boundary, reflect off of the sound reflecting boundary and subsequently proceed to the fictitious speaker.

14. The system of claim 11, wherein the system is one of a car stereo system and a home stereo system.

15. The system of claim 11, further comprising means for generating additional sounds.

16. A virtual reality system comprising the system of claim 11 and additionally a holographic imaging system.

17. The method of claim 9, further comprising generating additional sounds that create a different sound experience to the listener.

18. The method of claim 9, wherein the first region is a room.

* * * * *